United States Patent [19]

Stargardter

[11] 4,076,455

[45] Feb. 28, 1978

[54] ROTOR BLADE SYSTEM FOR A GAS TURBINE ENGINE

[75] Inventor: Hans Stargardter, Bloomfield, Conn.

[73] Assignee: United Technologies Corporation, Hartford, Conn.

[21] Appl. No.: 700,693

[22] Filed: Jun. 28, 1976

[51] Int. Cl.[2] ..... F01D 5/22

[52] U.S. Cl. ..... 416/191; 416/196 R; 416/217; 416/500

[58] Field of Search ..... 416/191, 196, 193 R, 416/193 A, 217, 190, 215, 500

[56] References Cited

U.S. PATENT DOCUMENTS

| | | | |
|---|---|---|---|
| 2,317,338 | 4/1943 | Rydmark | 416/500 X |
| 2,510,734 | 6/1950 | Bodger | 416/190 |
| 2,660,400 | 11/1953 | Griffith | 416/500 X |
| 2,944,787 | 7/1960 | Gingras | 16/193 A |
| 2,955,799 | 10/1960 | Oickle et al. | 416/500 |
| 3,307,775 | 3/1967 | Petrie | 416/196 X |
| 3,612,718 | 10/1971 | Palfreyman et al. | 416/193 X |
| 3,768,933 | 10/1973 | Bouiller et al. | 416/217 X |
| 3,918,840 | 11/1975 | Haworth et al. | 416/190 |

FOREIGN PATENT DOCUMENTS

| | | | |
|---|---|---|---|
| 137,405 | 3/1948 | Australia | 416/215 |

*Primary Examiner*—Everette A. Powell, Jr.
*Attorney, Agent, or Firm*—Robert C. Walker

[57] ABSTRACT

A rotor blade system which is adapted for long term reliable operation in a gas turbine engine is disclosed. Techniques for altering the natural frequency of the blade system to reduce the detrimental combined effects of external excitation and self-excitation are developed. One structure shown utilizes a shroud for the control of self-excitation in combination with a pin root to lower the fundamental first natural bending frequency of the blade system below the level of the 2E frequency at idle.

9 Claims, 6 Drawing Figures

FIG. 1
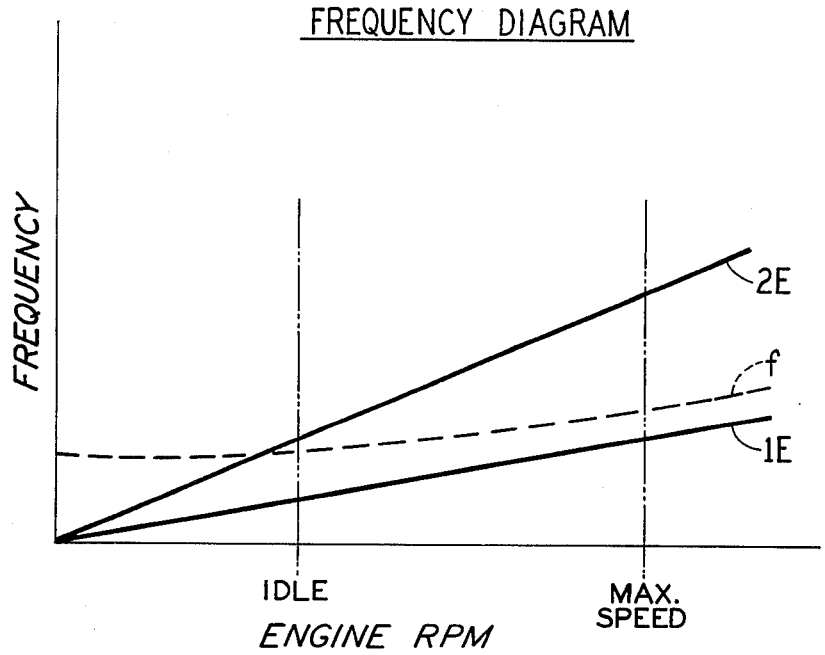
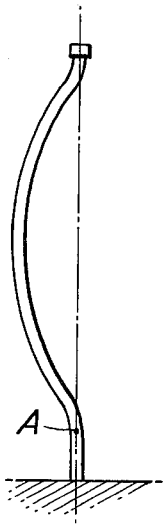
FIG. 5
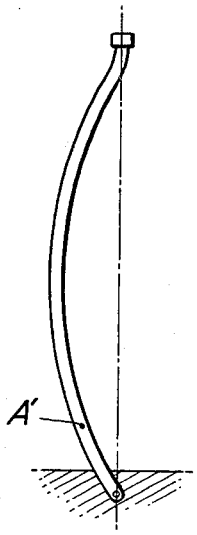
FIG. 5A

FIG. 2
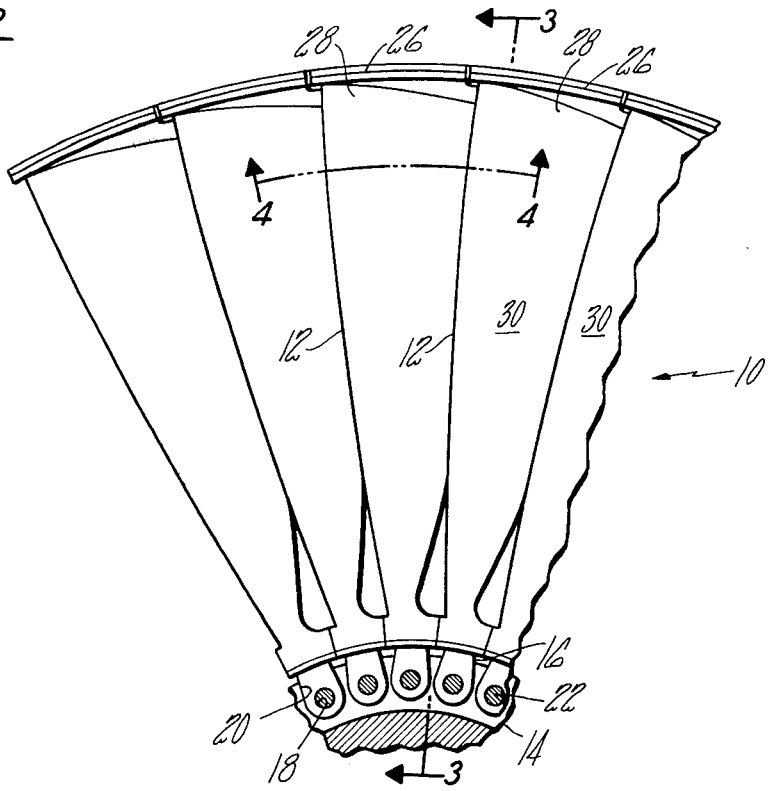
FIG. 3
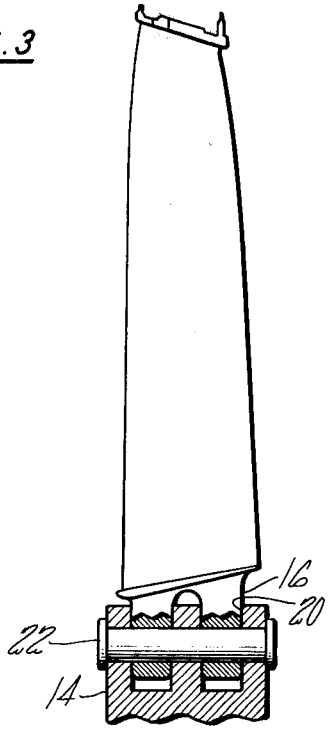
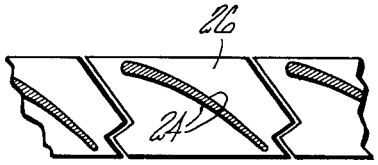
FIG. 4

ROTOR BLADE SYSTEM FOR A GAS TURBINE ENGINE

BACKGROUND OF THE INVENTION

1. Field of the Invention

This invention relates to gas turbine engines and more specifically to the blades of the compressor rotor assembly.

2. Description of the Prior Art

Scientists and engineers within the turbine engine field have long recognized that vibratory damage adversely limits the life of many turbine machines. They have also recognized that the blades of the rotor assembly are among the most susceptible of compressor components to vibratory damage. The blades are of necessity designed for low weight in order to minimize the centrifugally generated loads on the rotor. Lightweight blades, however, are not always compatible with the durability requirements of the engine and may severely limit the operating life of the engine where the natural frequency of the blade system in cycles per second falls within the operating range of the engine as expressed in revolutions per second, or a multiple thereof.

Where the operating speed of the engine in revolutions per second, or multiple thereof, is equal to the natural frequency of the blade system each of the individual blades begins to resonate. At resonance a vibratory deflection of large amplitude is induced by relatively small amplitude stimuli as the stimuli act in reinforcing concert with the periodic deflections of the blade. The large amplitude deflections produce severe mechanical stresses in the blade material and ultimately cause fatigue failure of the blade.

Blade deflecting stimuli are produced by nonuniform pressure patterns causing each blade to be cycled from low loading conditions to higher loading conditions. The variation in loading characteristics induces blade deflection and imposes a strain on the blade material. At resonance the natural frequency of each installed blade is coincident with the frequency of the stimulus. The deflection amplitudes become reinforcing and vibratory damage as discussed above results.

Struts or other protuberances within the engine flow path precipitate nonuniform pressure patterns. In the case of a single protuberance, a vibratory excitation, which is referred to as the 1E, one excitation per revolution of the rotor, excitation is established. The frequency of the 1E excitation in a gas turbine engine is normally below the fundamental natural bending frequency of the blade system and is rarely of concern to engine designers. The 2E excitation occurs as two pulses are generated for each revolution of the rotor. The 2E excitation often coincides with the fundamental natural bending frequency of the desired blade system. The 2E excitation is a particularly severe problem for front end blades, such as fan blades, as the traditionally preferred geometric shapes and contours have inherent natural frequencies which approximate the 2E excitation frequency within the engine operating range. Vibratory damage at the 2E frequency must be avoided by reducing the amplitude of the stimuli, by altering the natural frequency of the blade system, or by removing energy from the blade system through mechanical damping of the blades.

One blade system employing frictional damping apparatus for removing a portion of the vibratory energy is U.S. Pat. No. 3,314,652 to Geberth et al. In Geberth et al mechanical links, which join the tips of the rotor blades, frictionally damp the blades in response to centrifugally generated forces. The damping removes energy from the blade system to mitigate the adverse effects of torsional and bending vibration. Frictional damping has a limited potential for the control of vibratory damage in gas turbine engines. The amount of energy developed within the blade systems, and particularly within the fan blade systems, of modern engines exceeds the amount of energy that can be effectively dissipated by frictional damping apparatus without causing substantial wear on the friction surfaces of the apparatus. It is, therefore, that engine designers are exerting every possible effort to avoid blade systems which rely on frictional damping for long term system protection.

Alteration of the blade system natural frequency is considered to be an alternative to frictional damping. An understanding of the concepts involved is gained by focusing on the effects that stiffness and mass have upon the natural frequency of blade systems. The natural frequency of a cantilevered blade system is proportional to the square root of the stiffness divided by the mass.

$$f \sim \sqrt{(k/M)}$$

where $f$ = natural frequency of the blade system, $k$ = stiffness, and $M$ = mass.

Increasing the mass or decreasing the stiffness lowers the natural frequency. Decreasing the mass or increasing the stiffness raises the natural frequency. Such variations are employable to drive the natural frequency out of coincidence with 2E frequency within the engine operating range.

One current practice for avoiding destructive vibrations in gas turbine engines is to raise the natural frequency of the blade systems above the level of the 2E stimulus at maximum rotor speed. This is accomplished by adding part span or tip shrouds, increasing the stiffness of the system, or decreasing the mass of the system. Decreasing the mass of the system rarely results in a significant rise in the natural frequency as the removal of mass generally produces a corresponding decrease in stiffness. An increased mass, however, if judiciously distributed for increased stiffness will raise the natural frequency. It is this technique and the addition of part span or tip shrouds which are most commonly utilized in engines today.

U.S. Pat. No. 3,044,746 to H. Stargardter entitled "Fluid-Flow Machinery Blading" teaches the optimized use of blade mass to increase bending stiffness while maintaining adequate torsional stiffness to resist self-excited vibration. Such teachings of optimized mass distribution notwithstanding, any added system weight such as that added to stiffen blades raises the centrifugal loads which must be carried by the rotor.

Substantial efforts are continuing within the gas turbine industry to develop lightweight blade systems which avoid destructive resonant frequencies while maintaining high torsional stiffness.

SUMMARY OF THE INVENTION

The primary object of the present invention is to improve the durability of the rotor blades of a gas turbine engine. Improved resistance to vibratory damage is sought and in one embodiment specific goals are to provide a system having low natural bending frequencies while maintaining high natural torsional frequencies.

According to the present invention a pin type root connection is incorporated within the blade system of a gas turbine engine to lower the first natural bending frequency of the rotor blades, and a blade shroud is disposed between adjacent blades to increase the natural torsional frequency of the blade system.

A primary feature of the present invention is the combination of blade natural frequencies including a natural torsional frequency which is sufficiently high to resist blade flutter and including a first bending frequnecy which, in one embodiment, is below the 2E frequency of the engine at the idle operating condition. A pin type root attachment reduces the bending stiffness of the rotor blades and a correspondingly reduced natural bending frequency results. A blade shroud between adjacent blades of the system increases the torsional stiffness of the system and correspondingly increases the natural torsional frequency.

A principal advantage of the present invention is the reduced susceptibility of the blade system to vibratory damage. Destructive resonant bending modes are avoided by designing the natural bending frequency of the blade system, in one embodiment, at a level below the 2E frequency of the engine at idle operating conditions. Vibratory damage as a result of self-excitation is avoided by incorporating a shroud between adjacent blades of the system. The system described has significantly reduced weight when compared to systems of the prior art. The use of frictional damping apparatus within the blade system is avoided.

The foregoing and other objects, features and advantages of the present invention will become more apparent in the light of the following detailed description of the preferred embodiment thereof as shown in the accompanying drawing.

BRIEF DESCRIPTION OF THE DRAWING

FIG. 1 is a "Frequency Diagram" showing the relationship of the first natural bending frequency of the blade system of the present invention (f) and the frequency of the externally exciting stimuli (1E and 2E);

FIG. 2 is a simplified, front elevation view of a portion of the rotor blade system of the present invention;

FIG. 3 is a directional view taken along the line 3—3 as shown in FIG. 2;

FIG. 4 is a sectional view taken along the line 4—4 as shown in FIG. 2;

FIG. 5 is a simplified illustration of a rotor blade having a tip shroud and a fixed root in the first vibratory bending mode under external excitation; and FIG. 5A is a simplified illustration of a blade system having a tip shroud and a pin root in the first vibratory bending mode under external excitation.

DESCRIPTION OF THE PREFERRED EMBODIMENT

A simplified front elevation view which is representative of a rotor blade system 10 in a gas turbine engine is shown in FIG. 2. A plurality of individual rotor blades 12 extend radially outward from a rotor disk 14. Each blade has a root 16 including a pin receptacle 18 incorporated therein. Each blade root engages a slot 20 in the disk and is secured thereto by a pin 22 as is shown in FIG. 3. The engaged and secured blade is pivotal about the pin within the confines of the disk slot.

Each blade has a pair of airfoil surfaces 24 as shown in FIG. 4. A shroud 26 extends circumferentially from each airfoil surface into abutting relationship with the shrouds of the adjacent blades. The shrouds shown extend from the tip regions 28 of the blades, although midspan shroud locations 30 may be utilized in some embodiments. The structure shown is representative of the fan blade system of a turbofan engine. The concepts, however, are applicable to other rotor stages.

The two principal sources of vibratory stimulation on such a blade system are external excitation of the rotor blades and self-excitation of the rotor blades. External excitation causes blade bending in response to uneven pressure loadings upon the blades as the blades move circumferentially about the engine. Self-excitation occurs when the unsteady aerodynamic forces and moments created by periodic blade vibrations do positive aerodynamic work on the blade during each vibration cycle. Although self-excitation has occurred in the bending modes of vibration, it usually appears in the first torsional mode and is referred to as blade "flutter".

Each blade 12 has an inherent natural first bending frequency of vibration which, in accordance with one embodiment of the present invention, is tuned to a value which is less than the 2E frequency at the idle condition of the engine in which the blade is installed. The blade, resultantly, is never in prolonged resonance with the 2E frequency and the effects of prolonged resonance are avoided. Furthermore, below the idle condition the intensity of the 2E stimulus is low because the engine speed and airflow is low. Even prolonged coincidence between the 2E excitation and the natural frequency of the blade system below the idle condition will not usually cause fatigue failure of the blade material. A blade natural frequency which is five percent less than the 2E frequency at idle is considered to be an effective safety margin. Avoidance of the 2E stimulus is discussed herein by way of example. The concepts are equally applicable in the avoidance of higher or lower frequency stimuli.

The natural frequency of each blade is, as discussed in the prior art section, a function of the blade stiffness and of the blade mass. The pin root attachment between each blade and the rotor disk as shown in this invention reduces the blade bending stiffness without affecting the blade torsional stiffness. This decreased bending stiffness correspondingly decreases the natural bending frequency of the present blade system to a value below the 2E frequency at idle. FIGS. 5 and 5A show that the pin rooted attachment configuration stores less elastic energy in the first bending mode than its rigidly supported counterpart. The associated natural bending frequency of the pin root attached system (FIG. 5A) is lower than the corresponding cantilevered blade system (FIG. 5).

Reducing the first natural bending frequency of the blade system through the incorporation of a pin root does not increase the susceptibility of the blade system to torsional vibration or blade flutter. It may be advantageous, however, to further increase the resistance to blade flutter by incorporating a part span shroud which extends circumferentially between each pair of adjacent rotor blades. As the rotor blades begin to twist, adjacent shrouds are brought into abutting contact and oppose further to vibratory deflection. Although a tip shroud is shown in the preferred embodiment, the shroud may also be positioned at a midspan region.

The apparatus of the present invention offers a collateral benefit of reduced mechanical stress in the region A as shown in FIGS. 5 and 5A. FIG. 5A is a simplified illustration of a blade system having a pinned root attachment and a blade tip shroud. FIG. 5 is a simplified illustration of a blade held rigid at its base by a fixed attachment. The rigid attachment causes a buildup of severe mechanical stresses in the region A. In contrast, the blades of the present invention as represented by FIG. 5A have a pin root attachment which allows the blade to pivot within the confines of the disk slot. Substantially reduced bending stresses in the region A' result.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of my invention, that which I claim as new and desire to secure by Letters Patent of the United States is:

1. In a gas turbine engine a rotor blade system which is adapted for reduced susceptibility to vibratory damage wherein said blade system comprises:

a rotor disk; and a plurality of rotor blades cantilevered radially outward from the said disk wherein each blade is pivotally joined to the disk so as to be circumferentially deflectable under bending loads, and each blade has a shroud extending circumferentially from the airfoil surfaces of the blade into abutting relationship with the shrouds of the adjacent blades and wherein the natural bending frequency of each blade in the system is less than the 2E frequency at the idle condition of the engine in which the blade system is installed.

2. The invention according to claim 1 wherein the natural bending frequency of said blade system is more than five percent less than the 2E frequency at the idle operating condition of the engine in which the rotor is installed.

3. The invention according to claim 1 wherein the shroud of each blade is positioned at the tip of the blade.

4. The invention according to claim 1 wherein the shroud of each blade is positioned at the midspan region of the blade.

5. The invention according to claim 1 wherein each blade is affixed to the rotor disk by a pin which penetrates the root of the blade.

6. The invention according to claim 5 wherein the natural bending frequency of said blade system is more than five percent less than the 2E frequency at the idle operating condition of the engine in which the rotor is installed.

7. The invention according to claim 5 wherein the shroud of each blade is positioned at the tip of the blade.

8. The invention according to claim 5 wherein the shroud of each blade is positioned at the midspan region of the blade.

9. The method for reducing the susceptibility of a rotor blade of a gas turbine engine to vibratory damage, comprising the steps of:

providing a blade natural bending frequency which is less than the 2E frequency at idle operating conditions of the engine in which the blade is installed;

providing a pin root blade attachment to decrease the bending stresses in the root portion of the blade; and providing a blade shroud to reduce the self-excited torsional vibration of the blade system.

* * * * *